US005508135A

United States Patent [19]

Lelental et al.

[11] Patent Number: 5,508,135

[45] Date of Patent: Apr. 16, 1996

[54] IMAGING ELEMENT COMPRISING AN ELECTRICALLY-CONDUCTIVE LAYER EXHIBITING IMPROVED ADHESIVE CHARACTERISTICS

[75] Inventors: Mark Lelental; Jehuda Greener, both of Rochester, N.Y.

[73] Assignee: Eastman Kodak Company, Rochester, N.Y.

[21] Appl. No.: 433,305

[22] Filed: May 3, 1995

[51] Int. Cl.[6] ..... G03G 15/04

[52] U.S. Cl. ..... 430/63; 430/527; 430/529; 430/530; 430/631; 430/640; 430/950

[58] Field of Search ..... 430/63, 527, 529, 430/530, 631, 950, 640

[56] References Cited

U.S. PATENT DOCUMENTS 4,275,103 6/1981 Tsubusaki et al. .

4,416,963 11/1983 Takimoto et al. ..... 430/627

5,122,445 6/1992 Ishigaki et al. .

5,340,676 8/1994 Anderson et al. .

FOREIGN PATENT DOCUMENTS 0618489 10/1994 European Pat. Off. .

*Primary Examiner*—Thorl Chea

*Attorney, Agent, or Firm*—Alfred P. Lorenzo

[57] ABSTRACT

Imaging elements, such as photographic, electrostatographic and thermal imaging elements, are comprised of a support, an image-forming layer and an electrically-conductive layer comprising electrically-conductive metal-containing particles dispersed in a binder system comprising a blend of a film-forming polymer and an anionic polymer. The combination of electrically-conductive metal-containing particles, film-forming polymer and anionic polymer provides a controlled degree of electrical conductivity and excellent adhesion to gelatin-containing layers, such as silver halide emulsion layers of photographic elements, in adhering contact with the electrically-conductive layer.

17 Claims, No Drawings

IMAGING ELEMENT COMPRISING AN ELECTRICALLY-CONDUCTIVE LAYER EXHIBITING IMPROVED ADHESIVE CHARACTERISTICS

FIELD OF THE INVENTION

This invention relates in general to imaging elements, such as photographic, electrostatographic and thermal imaging elements, and in particular to imaging elements comprising a support, an image-forming layer and an electrically-conductive layer. More specifically, this invention relates to electrically-conductive layers comprising electrically-conductive metal-containing particles and to the use of such electrically-conductive layers in imaging elements for such purposes as providing protection against the generation of static electrical charges or serving as an electrode which takes part in an image-forming process.

BACKGROUND OF THE INVENTION

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layer(s) can produce irregular fog patterns or "static marks" in the emulsion. The severity of static problems has been exacerbated greatly by increases in the sensitivity of new emulsions, increases in coating machine speeds, and increases in post-coating drying efficiency. The charge generated during the coating process results primarily from the tendency of webs of high dielectric polymeric film base to charge during winding and unwinding operations (unwinding static), during transport through the coating machines (transport static), and during post-coating operations such as slitting and spooling. Static charge can also be generated during the use of the finished photographic film product. In an automatic camera, the winding of roll film out of and back into the film cassette, especially in a low relative humidity environment, can result in static charging. Similarly, high-speed automated film processing can result in static charge generation. Sheet films are especially subject to static charging during removal from light-tight packaging (e.g., x-ray films).

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. Most of the traditional antistatic systems for photographic applications employ ionic conductors. Charge is transferred in ionic conductors by the bulk diffusion of charged species through an electrolyte. Antistatic layers containing simple inorganic salts, alkali metal salts of surfactants, ionic conductive polymers, polymeric electrolytes containing alkali metal salts, and colloidal metal oxide sols (stabilized by metal salts) have been described previously. The conductivities of these ionic conductors are typically strongly dependent on the temperature and relative humidity in their environment. At low humidities and temperatures, the diffusional mobilities of the ions are greatly reduced and conductivity is substantially decreased. At high humidities, antistatic backcoatings often absorb water, swell, and soften. In roll film, this results in adhesion of the backcoating to the emulsion side of the film. Also, many of the inorganic salts, polymeric electrolytes, and low molecular weight surfactants used are water-soluble and are leached out of the antistatic layers during processing, resulting in a loss of antistatic function.

Antistatic systems employing electronic conductors have also been described. Because the conductivity depends predominantly on electronic mobilities rather than ionic mobilities, the observed electronic conductivity is independent of relative humidity and only slightly influenced by the ambient temperature. Antistatic layers have been described which contain conjugated polymers, conductive carbon particles or semiconductive inorganic particles.

Trevoy (U.S. Pat. No. 3,245,833) has taught the preparation of conductive coatings containing semiconductive silver or copper iodide dispersed as particles less than 0.1 μm in size in an insulating film-forming binder, exhibiting a surface resistance of $10^2$ to $10^{11}$ ohms per square . The conductivity of these coatings is substantially independent of relative humidity. Also, the coatings are relatively clear and sufficiently transparent to permit their use as antistatic coatings for photographic film. However, if a coating containing copper or silver iodides was used as a subbing layer on the same side of the film base as the emulsion, Trevoy found (U.S. Pat. No. 3,428,451) that it was necessary to overcoat the conductive layer with a dielectric, water-impermeable barrier layer to prevent migration of semiconductive salt into the silver halide emulsion layer during processing. Without the barrier layer, the semiconductive salt could interact deleteriously with the silver halide layer to form fog and a loss of emulsion sensitivity. Also, without a barrier layer, the semiconductive salts are solubilized by processing solutions, resulting in a loss of antistatic function.

Another semiconductive material has been disclosed by Nakagiri and Inayama (U.S. Pat. No. 4,078,935) as being useful in antistatic layers for photographic applications. Transparent, binderless, electrically semiconductive metal oxide thin films were formed by oxidation of thin metal films which had been vapor deposited onto film base. Suitable transition metals include titanium, zirconium, vanadium, and niobium. The microstructure of the thin metal oxide films is revealed to be non-uniform and discontinuous, with an "island" structure almost "particulate" in nature. The surface resistivity of such semiconductive metal oxide thin films is independent of relative humidity and reported to range from $10^5$ to $10^9$ ohms per square. However, the metal oxide thin films are unsuitable for photographic applications since the overall process used to prepare these thin films is complicated and costly, abrasion resistance of these thin films is low, and adhesion of these thin films to the base is poor.

A highly effective antistatic layer incorporating an "amorphous" semiconductive metal oxide has been disclosed by Guestaux (U.S. Pat. No. 4,203,769). The antistatic layer is prepared by coating an aqueous solution containing a colloidal gel of vanadium pentoxide onto a film base. The colloidal vanadium pentoxide gel typically consists of entangled, high aspect ratio, flat ribbons 50–100 Å wide, about 10 Å thick, and 1,000–10,000 Å long. These ribbons stack flat in the direction perpendicular to the surface when the gel is coated onto the film base. This results in electrical conductivities for thin films of vanadium pentoxide gels (about 1 $\Omega^{-1}cm^{-1}$) which are typically about three orders of magnitude greater than is observed for similar thickness films containing crystalline vanadium pentoxide particles. In addition, low surface resistivities can be obtained with very low vanadium pentoxide coverages. This results in low optical absorption and scattering losses. Also, the thin films are highly adherent to appropriately prepared film bases. However, vanadium pentoxide is soluble at high pH and must be overcoated with a non-permeable, hydrophobic barrier layer in order to survive processing. When used with a conductive subbing layer, the barrier layer must be coated with a hydrophilic layer to promote adhesion to emulsion layers above. (See Anderson et al, U.S. Pat. No. 5,006,451.)

Conductive fine particles of crystalline metal oxides dispersed with a polymeric binder have been used to prepare optically transparent, humidity insensitive, antistatic layers for various imaging applications. Many different metal oxides—such as ZnO, $TiO_2$, $ZrO_2$, $SnO_2$, $Al_2O_3$, $In_2O_3$, $SiO_2$, MgO, BaO, $MoO_3$ and $V_2O_5$—are alleged to be useful as antistatic agents in photographic elements or as conductive agents in electrostatographic elements in such patents as U.S. Pat. Nos. 4,275,103, 4,394,441, 4,416,963, 4,418,141, 4,431,764, 4,495,276, 4,571,361, 4,999,276 and 5,122,445. However, many of these oxides do not provide acceptable performance characteristics in these demanding environments. Preferred metal oxides are antimony doped tin oxide, aluminum doped zinc oxide, and niobium doped titanium oxide. Surface resistivities are reported to range from $10^6$–$10^9$ ohms per square for antistatic layers containing the preferred metal oxides. In order to obtain high electrical conductivity, a relatively large amount (0.05–10 g/$m^2$) of metal oxide must be included in the antistatic layer. This results in decreased optical transparency for thick antistatic coatings. The high values of refractive index (>2.0) of the preferred metal oxides necessitates that the metal oxides be dispersed in the form of ultrafine (<0.1 μm) particles in order to minimize light scattering (haze) by the antistatic layer.

Antistatic layers comprising electro-conductive ceramic particles, such as particles of TiN, $NbB_2$, TiC, $LaB_6$ or MoB, dispersed in a binder such as a water-soluble polymer or solvent-soluble resin are described in Japanese Kokai No. 4/55492, published Feb. 24, 1992.

Fibrous conductive powders comprising antimony-doped tin oxide coated onto non-conductive potassium titanate whiskers have been used to prepare conductive layers for photographic and electrographic applications. Such materials are disclosed, for example, in U.S. Pat. Nos. 4,845,369 and 5,116,666. Layers containing these conductive whiskers dispersed in a binder reportedly provide improved conductivity at lower volumetric concentrations than other conductive fine particles as a result of their higher aspect ratio. However, the benefits obtained as a result of the reduced volume percentage requirements are offset by the fact that these materials are relatively large in size such as 10 to 20 micrometers in length, and such large size results in increased light scattering and hazy coatings.

Use of a high volume percentage of conductive fine particles in an electro-conductive coating to achieve effective antistatic performance results in reduced transparency due to scattering losses and in the formation of brittle layers that are subject to cracking and exhibit poor adherence to the support material. It is thus apparent that it is extremely difficult to obtain non-brittle, adherent, highly transparent, colorless electro-conductive coatings with humidity-independent process-surviving antistatic performance.

The requirements for antistatic layers in silver halide photographic films are especially demanding because of the stringent optical requirements. Other types of imaging elements such as photographic papers and thermal imaging elements also frequently require the use of an antistatic layer but, generally speaking, these imaging elements have less stringent requirements.

A specific example of electrically-conductive layers which are especially advantageous for use in imaging elements and are capable of effectively meeting the stringent optical requirements of silver halide photographic elements are layers comprising a dispersion in a film-forming binder of fine particles of an electronically-conductive metal antimonate as described in Christian et al, U.S. Pat. No. 5,368,995, issued Nov. 29, 1994. For use in imaging elements, the average particle size of the electronically-conductive metal antimonate is preferably less than about one micrometer and more preferably less than about 0.5 micrometers. For use in imaging elements where a high degree of transparency is important, it is preferred to use colloidal particles of an electronically-conductive metal antimonate, which typically have an average particle size in the range of 0.01 to 0.05 micrometers. The preferred metal antimonates have rutile or rutile-related crystallographic structures and are represented by either Formula (I) or Formula (II) below:

$$M^{+2}Sb^{+5}{}_2O_6 \text{ wherein } M^{+2}=Zn^{+2}, Ni^{+2}, Mg^{+2}, Fe^{+2}, Cu^{+2}, Mn^{+2}, Co^{+2} \quad \text{(I)}$$

$$M^{+3}Sb^{+5}O_4 \text{ where } M^{+3}=In^{+3}, Al^{+3}, Sc^{+3}, Cr^{+3}, Fe^{+3}, Ga^{+3} \quad \text{(II)}$$

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are resistant to the effects of humidity change, which are durable and abrasion-resistant, which are effective at low coverage, which are adaptable to use with transparent imaging elements, which do not exhibit adverse sensitometric or photographic effects, and which are substantially insoluble in solutions with which the imaging element typically comes in contact, for example, the aqueous alkaline developing solutions used to process silver halide photographic films.

Many imaging elements of the type hereinabove described include one or more layers which contain gelatin. Thus, the electrically-conductive layer is commonly in adhering contact with a layer containing gelatin. Examples of photographic elements of such structure include elements in which the electrically-conductive layer is a subbing layer underlying a gelatin silver halide emulsion layer or a gelatin-containing anticurl layer, elements in which the electrically-conductive layer is an overcoat layer overlying a gelatin silver halide emulsion layer, and elements in which the electrically-conductive layer is an outermost layer overlying a gelatin-containing anticurl layer on the side of the support opposite to the silver halide emulsion layer.

It is extremely difficult to get adequate adhesion between an electrically-conductive layer which comprises a high concentration of electrically-conductive metal-containing particles and a gelatin-containing layer which is in adhering contact therewith. A major factor contributing to the adhesion problem is that the volumetric ratio of electrically-conductive metal-containing particles to binder in the electrically-conductive layer must usually be quite high in order to get the high level of electrical conductivity that is desired. For example, the electrically-conductive metal-containing particles typically constitute 20 to 80 or more volume percent of the electrically-conductive layer. As a result of too small an amount of binder being present in the electrically-conductive layer, there can be a serious problem of inadequate adhesion to gelatin-containing layers that are in adhering contact therewith.

It is toward the objective of providing an improved electrically-conductive layer, which provides high conductivity and which also provides excellent adhesive characteristics for gelatin-containing layers which are in adhering contact therewith, that the present invention is directed.

SUMMARY OF THE INVENTION

In accordance with this invention, an imaging element for use in an image-forming process comprises a support, an image-forming layer and an electrically-conductive layer. The electrically-conductive layer, which is in adhering contact with a gelatin-containing layer, is comprised of electrically-conductive metal-containing particles dispersed in a binder system comprising a blend of a film-forming polymer and an anionic polymer. The anionic polymer is compatible with the film-forming polymer so as to avoid phase separation and has a high gelatin binding efficiency by virtue of the fact that it includes one or more anionic moieties that are capable of binding with gelatin. Interaction of the anionic moieties with the gelatin present in the gelatin-containing layer that is in adhering contact with the electrically-conductive layer enhances the adhesion of the electrically-conductive layer and thereby avoids or minimizes problems of adhesive failure.

Of particular utility in this invention, are polymers having one or more pendant anionic moieties selected from $—OSO_3M$, $—SO_3M$, —COOM and $—OPO(OM)_2$ where M represents a hydrogen atom or a cationic counterion such as an alkali metal, an alkaline earth metal or a quaternary ammonium base.

In the imaging elements of this invention, the ratio of electrically-conductive metal-containing particles to the binder system must be sufficiently high to provide the desired high level of electrical conductivity, such as a resistivity of less than $1\times 10^{12}$ ohms/square and preferably of less than $1\times10^{9}$ ohms/square. Typically, this ratio is such that the electrically-conductive metal-containing particles represent 20 to 80 percent by volume of the electrically-conductive layer.

The polymer having the anionic moieties must be compatible with the film-forming polymer and have a high gelatin binding efficiency sufficient to achieve the desired improvement in adhesion. The ratio of the anionic polymer to film-forming polymer in the binder system must be sufficient to enhance the adhesion of the electrically-conductive layer to the gelatin-containing layer in adhering contact therewith but insufficient to significantly degrade the cohesive strength of the electrically-conductive layer, since cohesive failure in imaging elements is of as much concern as adhesive failure.

The combination of appropriate amounts of electrically-conductive metal-containing particles, film-forming polymer and polymer having anionic moieties provides a controlled degree of electrical conductivity and beneficial chemical, physical and optical properties which adapt the electrically-conductive layer for such purposes as providing protection against static or serving as an electrode which takes part in an image-forming process. Comparable properties cannot be achieved by using only the combination of electrically-conductive metal-containing particles and film-forming polymer or the combination of electrically-conductive metal-containing particles and polymer having anionic moieties. Thus, all three of the components specified and their use in appropriate ratios with respect to one another are essential to achieving the desired results.

DESCRIPTION OF THE PREFERRED EMBODIMENTS

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polyester ionomer film, polycarbonate film, glass, metal, paper, polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly(vinylpyrrolidone), acrylamide polymers, and the like. A particularly common example of an image-forming layer is a gelatin-silver halide emulsion layer.

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically-conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

In electrostatographic elements, the electrically-conductive layer can be a separate layer, a part of the support layer or the support layer. There are many types of conducting layers known to the electrostatographic art, the most common being listed below:

(a) metallic laminates such as an aluminum paper laminate, (b) metal plates, e.g., aluminum, copper, zinc, brass, etc., (c) metal foils such as aluminum foil, zinc foil, etc., (d) vapor deposited metal layers such as silver, aluminum, nickel, etc., (e) semiconductors dispersed in resins such as poly(ethylene terephthalate) as described in U.S. Pat. No. 3,245,833, (f) electrically conducting salts such as described in U.S. Pat. Nos. 3,007,801 and 3,267,807.

Conductive layers (d), (e) and (f) can be transparent and can be employed where transparent elements are required, such as in processes where the element is to be exposed from the back rather than the front or where the element is to be used as a transparency.

Thermally processable imaging elements, including films and papers, for producing images by thermal processes are well known. These elements include thermographic elements in which an image is formed by imagewise heating the element. Such elements are described in, for example, *Research Disclosure,* June 1978, Item No. 17029; U.S. Pat. Nos. 3,457,075; 3,933,508; and U.S. Pat. No. 3,080,254.

Photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

Photothermographic elements also comprise a photosensitive component which consists essentially of photographic silver halide. In photothermographic materials it is believed that the latent image silver from the silver halide acts as a catalyst for the oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful.

Migration imaging processes typically involve the arrangement of particles on a softenable medium. Typically, the medium, which is solid and impermeable at room temperature, is softened with heat or solvents to permit particle migration in an imagewise pattern.

As disclosed in R. W. Gundlach, "Xeroprinting Master with Improved Contrast Potential", *Xerox Disclosure Journal,* Vol. 14, No. 4, July/August 1984, pages 205–06, migration imaging can be used to form a xeroprinting master element. In this process, a monolayer of photosensitive particles is placed on the surface of a layer of polymeric material which is in contact with a conductive layer. After charging, the element is subjected to imagewise exposure which softens the polymeric material and causes migration of particles where such softening occurs (i.e., image areas). When the element is subsequently charged and exposed, the image areas (but not the non-image areas) can be charged, developed, and transferred to paper.

Another type of migration imaging technique, disclosed in U.S. Pat. No. 4,536,457 to Tam, U.S. Pat. No. 4,536,458 to Ng, and U.S. Pat. No. 4,883,731 to Tam et al, utilizes a solid migration imaging element having a substrate and a layer of softenable material with a layer of photosensitive marking material deposited at or near the surface of the softenable layer. A latent image is formed by electrically charging the member and then exposing the element to an imagewise pattern of light to discharge selected portions of the marking material layer. The entire softenable layer is then made permeable by application of the marking material, heat or a solvent, or both. The portions of the marking material which retain a differential residual charge due to light exposure will then migrate into the softened layer by electrostatic force.

An imagewise pattern may also be formed with colorant particles in a solid imaging element by establishing a density differential (e.g., by particle agglomeration or coalescing) between image and non-image areas. Specifically, colorant particles are uniformly dispersed and then selectively migrated so that they are dispersed to varying extents without changing the overall quantity of particles on the element.

Another migration imaging technique involves heat development, as described by R. M. Schaffert, Electrophotography, (Second Edition, Focal Press, 1980), pp. 44–47 and U.S. Pat. No. 3,254,997. In this procedure, an electrostatic image is transferred to a solid imaging element, having colloidal pigment particles dispersed in a heat-softenable resin film on a transparent conductive substrate. After softening the film with heat, the charged colloidal particles migrate to the oppositely charged image. As a result, image areas have an increased particle density, while the background areas are less dense.

An imaging process known as "laser toner fusion", which is a dry electrothermographic process, is also of significant commercial importance. In this process, uniform dry powder toner depositions on non-photosensitive films, papers, or lithographic printing plates are imagewise exposed with high power (0.2–0.5 W) laser diodes thereby, "tacking" the toner particles to the substrate(s). The toner layer is made, and the non-imaged toner is removed, using such techniques as electrographic "magnetic brush" technology similar to that found in copiers. A final blanket fusing step may also be needed, depending on the exposure levels.

Another example of imaging elements which employ an antistatic layer are dye-receiving elements used in thermal dye transfer systems.

Thermal dye transfer systems are commonly used to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are described in U.S. Pat. No. 4,621,271.

In EPA No. 194,106, antistatic layers are disclosed for coating on the back side of a dye-receiving element. Among the materials disclosed for use are electrically-conductive inorganic powders such as a "fine powder of titanium oxide or zinc oxide."

Another type of image-forming process in which the imaging element can make use of an electrically-conductive layer is a process employing an imagewise exposure to electric current of a dye-forming electrically-activatable recording element to thereby form a developable image followed by formation of a dye image, typically by means of thermal development. Dye-forming electrically activatable recording elements and processes are well known and are described in such patents as U.S. Pat. Nos. 4,343,880 and 4,727,008.

In the imaging elements of this invention, the image-forming layer can be any of the types of image-forming layers described above, as well as any other image-forming layer known for use in an imaging element.

All of the imaging processes described hereinabove, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

As described hereinabove, the imaging elements of this invention include an electrically-conductive layer which is in adhering contact with a gelatin-containing layer. The electrically-conductive layer is comprised of electrically-conductive metal-containing particles dispersed in a binder system comprising a blend of a film-forming polymer and a polymer having one or more anionic moieties that are capable of binding with gelatin.

It is a key feature of this invention that the binder system of the electrically-conductive layer is a blend of two different polymers, one of which is a film-former that provides the necessary cohesive strength to the layer and the other of which is an adhesion-promoter that binds to the gelatin in the gelatin-containing layer that is in adhering contact with the electrically-conductive layer.

Any of the wide diversity of electrically-conductive metal-containing particles proposed for use heretofore in imaging elements can be used in the electrically-conductive layer of this invention. Examples of useful electrically-conductive metal-containing particles include donor-doped metal oxides, metal oxides containing oxygen deficiencies, and conductive nitrides, carbides or borides. Specific examples of particularly useful particles include conductive $TiO_2$, $SnO_2$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN and ZrC.

Particular preferred metal oxides for use in this invention are antimony-doped tin oxide, tin-doped indium oxide, aluminum-doped zinc oxide and niobium-doped titanium oxide.

In a particular embodiment of the present invention, the electrically-conductive metal-containing particles are particles of an electronically-conductive metal antimonate as described in U.S. Pat. No. 5,368,995.

In the imaging elements of this invention, the electrically-conductive metal-containing particles preferably have an average particle size of less than one micrometer, more preferably of less than 0.3 micrometers, and most preferably of less than 0.1 micrometers. It is also advantageous that the electrically-conductive metal-containing particles exhibit a powder resistivity of $10^5$ ohm-centimeters or less, more preferably less than $10^3$ ohm-centimeters and most preferably less than $10^2$ ohm-centimeters.

Film-forming polymers useful in the electrically-conductive layer of this invention include water-soluble polymers such as gelatin, gelatin derivatives and maleic acid anhydride copolymers; cellulose compounds such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamides, their derivatives and partially hydrolyzed products, vinyl polymers and copolymers such as polyvinyl acetate and polyacrylate acid esters; derivatives of the above polymers; and other synthetic resins. Other suitable film-formers include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, olefins, and aqueous dispersions of polyurethanes.

As hereinabove described, the adhesion-promoting polymer that is utilized as a component of the binder system in the electrically-conductive layer of this invention is a polymer having one or more anionic moieties that are capable of binding with gelatin.

Preferred adhesion-promoters are polymers having one or more pendant anionic moieties selected from $—OSO_3M$, $—SO_3M$, —COOM and $—OPO(OM)_2$ wherein M represents a hydrogen atom or a cationic counterion. Examples of useful counterions include alkali metals, alkaline earth metals and quaternary ammonium bases.

The molecular weight of the adhesion promoting polymer can range from several thousand to several million. Preferably, the molecular weight is above 50,000. The adhesion-promoting polymers can be homopolymers or copolymers. They preferably comprise from 50 to 100 percent by weight of units derived from anionic monomers comprising one or more of the specified anionic moieties.

Sulfonated polymers are preferred for use as the adhesion-promoting polymer in this invention and poly(aryl sulfonates) such as polystyrene sulfonate (referred to herein as PSS) are particularly preferred because of their high gelatin binding efficiency. Other useful sulfonated polymers include copolymers of styrene sulfonate, such as the copolymer of styrene sulfonate and maleic acid; homopolymers and copolymers of vinylsulfonates, homopolymers and copolymers of allyl sulfonates and homopolymers and copolymers of alkyl vinyl benzene sulfonates.

A further preferred group of adhesion-promoters are naturally occurring polysaccharides modified by sulfation or sulfonation.

The combination of a film-former and polystyrene sulfonate, or other anionically charged polymer, is able to provide improved adhesion characteristics between an electrically-conductive layer comprising electrically-conductive metal-containing particles and a gelatin-containing layer in adhering contact therewith by virtue of the strong affinity of the charged polymer to gelatin. Under appropriate pH (above the isoelectric point of gelatin, for example above 5.0 for alkali-processed gelatin) and ionic strength (<0.01N) conditions, charged polymers as described herein bind very strongly to gelatin to form a stable complex or network structure. Such a complexation process is the basis for the use of charged polymers as thickeners for gelatin. The charged polymers useful in this invention can contain uncharged comonomer or comonomers with mixed ionic moieties, with the ions being fully or partially neutralized. The ions may be positioned on the polymer backbone or on a side chain, although pendant anionic groups are preferred.

Specific examples of polymers which include anionic moieties and are useful as adhesion-promoters herein include the following (in these examples M represents a hydrogen atom or a cationic counterion):

P-1

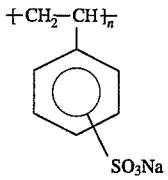

P-2

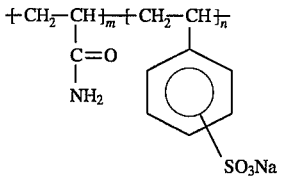

P-3

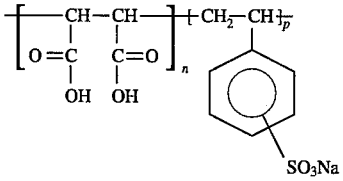

-continued

P-4

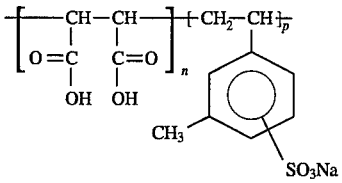

P-5

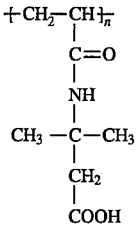

P-6

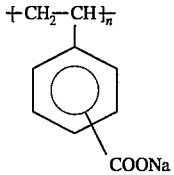

P-7

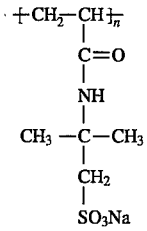

P-8

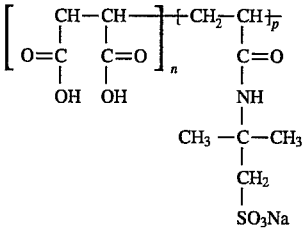

P-9

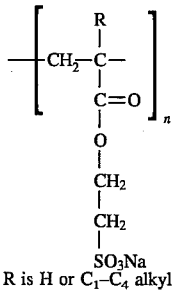

R is H or $C_1$–$C_4$ alkyl

-continued

P-10

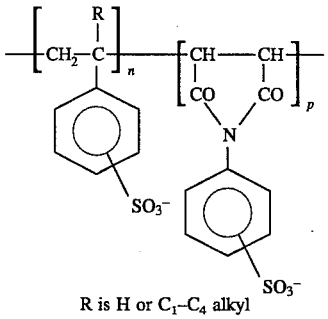

R is H or $C_1$–$C_4$ alkyl

P-11

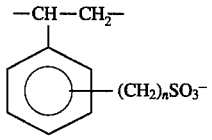

P-12

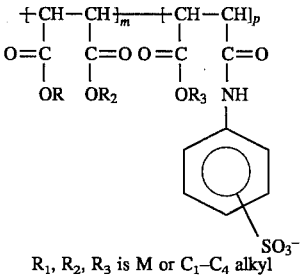

$R_1$, $R_2$, $R_3$ is M or $C_1$–$C_4$ alkyl (P-13

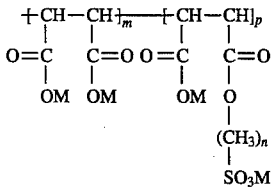

P-14

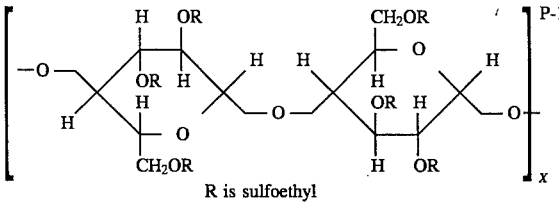

R is sulfoethyl

P-15

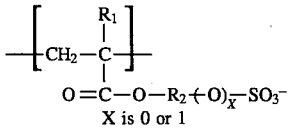

X is 0 or 1

$R_1$ is H or $C_1$–$C_4$ alkyl $R_2$ is $C_1$–$C_4$ alkylene

P-16

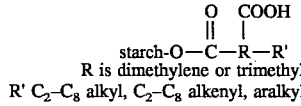

R is dimethylene or trimethylene

R' $C_2$–$C_8$ alkyl, $C_2$–$C_8$ alkenyl, aralkyl or aralkenyl

P-17

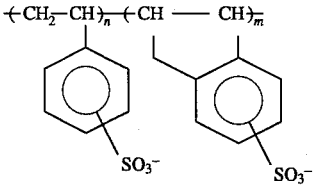

In the electrically-conductive layer of this invention, the electrically-conductive metal-containing particles are preferably incorporated in a volumetric proportion sufficient to provide a resistivity of less than $1\times10^{12}$ ohms/square and more preferably of less than $1\times10^{9}$ ohms/square. The electrically-conductive metal-containing particles preferably constitute 20 to 80 percent by volume and most preferably 50 to 80 percent by volume of the electrically-conductive layer.

In the binder blend of this invention, the film-former and the adhesion-promoter must be so selected that they are compatible with one another. The particular proportions in which they are used can vary widely depending on the particular film-former and adhesion-promoter selected. As indicated hereinabove, the ratio of the adhesion-promoter to the film-former must be sufficient to enhance the adhesion of the electrically-conductive layer to the gelatin-containing layer that is in adhering contact therewith but insufficient to significantly degrade the cohesive strength of the electrically-conductive layer. Preferably, the amount of adhesion-promoter employed is in the range of from about 0.04 to about 0.12 parts per part by weight of the film-former and more preferably in the range of from about 0.05 to about 0.10 parts per part by weight of the film-former. The optimum ratio of the adhesion-promoter to the film-former is dependent on numerous factors including the molecular weights of the adhesion-promoter and the film-former, the pH, the ionic strength, and the type of gelatin in the layer in adhering contact with the electrically-conductive layer.

In addition to the electrically-conductive metal-containing particles, film-forming polymer and adhesion-promoting polymer, the electrically-conductive layer can optionally contain wetting aids, lubricants, matte particles, biocides, dispersing aids, hardeners and antihalation dyes. The electrically-conductive layer is typically applied from an aqueous coating formulation that is preferably formulated to give a dry coating weight in the range of from about 50 to about 1500 mg/$m^2$.

Particularly useful imaging elements within the scope of this invention are those in which the support is a transparent polymeric film, the image-forming layer is comprised of silver halide grains dispersed in gelatin, the film-forming polymer in the electrically-conductive layer is gelatin, the electrically-conductive metal-containing particles are antimony-doped tin oxide particles and the adhesion-promoter in the electrically-conductive layer is polystyrene sulfonate.

An antistatic layer as described herein can be applied to a photographic film support in various configurations depending upon the requirements of the specific photographic application. In the case of photographic elements for graphic arts applications, an antistatic layer can be applied to a polyester film base during the support manufacturing process after orientation of the cast resin and coating thereof with a polymer undercoat layer. The antistatic layer can be applied as a subbing layer on the sensitized emulsion side of the support, on the side of the support opposite the emulsion or on both sides of the support. When the antistatic layer is applied as a subbing layer on the same side as the sensitized emulsion, it is not necessary to apply any intermediate layers such as barrier layers or adhesion promoting layers between it and the sensitized emulsion, although they can optionally be present. Alternatively, the antistatic layer can be applied as part of a multi-component curl control layer on the side of the support opposite to the sensitized emulsion during film sensitizing. The antistatic layer would typically be located closest to the support. An intermediate layer, containing primarily binder and antihalation dyes functions as an antihalation layer. The outermost layer typically contains binder, matte, and surfactants and functions as a protective overcoat layer. The outermost layer can, if desired, serve as the antistatic layer. Additional addenda, such as polymer latexes to improve dimensional stability, hardeners or cross linking agents, and various other conventional additives as well as conductive particles can be present in any or all of the layers.

In the case of photographic elements for direct or indirect x-ray applications, the antistatic layer can be applied as a subbing layer on either side or both sides of the film support. In one type of photographic element, the antistatic subbing layer is applied to only one side of the support and the sensitized emulsion coated on both sides of the film support. Another type of photographic element contains a sensitized emulsion on only one side of the support and a pelloid containing gelatin on the opposite side of the support. An antistatic layer can be applied under or over the sensitized emulsion or, preferably, the pelloid. Additional optional layers can be present. In another photographic element for x-ray applications, an antistatic subbing layer can be applied either under or over a gelatin subbing layer containing an antihalation dye or pigment. Alternatively, both antihalation and antistatic functions can be combined in a single layer containing conductive particles, antihalation dye, the film-forming hydrophilic colloid and the pre-crosslinked gelatin particles. This hybrid layer can be coated on one side of a film support under the sensitized emulsion.

The invention is further illustrated by the following examples of its practice.

EXAMPLES 1–3

A coating composition, suitable for the preparation of an electrically-conductive layer, was prepared by combining 278.36 g of demineralized water, 0.8 g of gelatin, 0.81 g of 3,6-dimethyl-4-chlorophenol dissolved in 0.22 g of methyl alcohol, 0.159 g of a 15% aqueous solution of potassium chrome alum, 0.20 g of a 15% aqueous saponin solution, 0.075 g of a 40% aqueous dispersion of polymethylmethacrylate matte particles, and 36 g of a 30% aqueous dispersion of antimony-doped tin oxide particles (STANOSTAT CPM-375 particles obtained from Keeling & Walker Ltd.) stabilized with 0.85% of a dispersing aid (DEQUEST 2006 dispersing aid obtained from Monsanto Corporation).

A control element, designated Control Element 1, was prepared by applying a coating of the aforesaid composition with a wet laydown of 11 ml/m$^2$ to a 0.1 millimeter thick polyethylene terephthalate film support that was coated with a subbing layer comprised of a vinylidene chloride/acrylonitrile/itaconic acid terpolymer. The wet laydown corresponded to an antimony-doped tin oxide dry weight coverage of 200 mg/m$^2$. The electrically-conductive layer containing the antimony-doped tin oxide was overcoated with a gelatin-containing silver halide emulsion layer identical to that used in KODAK TMAT-G/RA film.

The surface electrical resistivity of the electrically-conductive layer was measured, after conditioning for 24 hours at 32° C. and 50% relative humidity, using a two-probe parallel electrode method as described in U.S. Pat. No. 2,801,191.

To determine the strength with which the silver halide emulsion layer adhered to the underlying electrically-conductive layer, Control Element 1 was subjected to an AO wet abrader test. In carrying out this test, the element was scribed by a controlled weighted point and then placed into an abrader tray that was filled with a 20° C. solution of a photographic developing composition (developer TA-55 available from Eastman Kodak Company). A rubber pad, at 900 gram load, was cycled 100 times across the scribe line at a rate of 60 cycles per minute and the percent area removed was determined. The element was subjected to the wet abrasion test after 24 hours of incubation at 32° C. and 50% relative humidity.

Control Element 2 differed from Control Element 1 in that the dry weight coverage of antimony-doped tin oxide was 300 mg/m$^2$ rather than 200 mg/m$^2$.

The element of Example 1 differed from Control Element 1 in that the binder in the electrically-conductive layer was a blend of 90.9 weight percent gelatin and 9.1 weight percent polystyrene sulfonate with a molecular weight of 130000 (VERSA TL-130 polystyrene sulfonate from National Starch and Chemical Company.)

The element of Example 2 differed from Control Element 2 in that the binder in the electrically-conductive layer was a blend of 95 weight percent gelatin and 5 weight percent VERSA TL-130 polystyrene sulfonate.

The element of Example 3 differed from Control Element 2 in that the binder in the electrically-conductive layer was a blend of 90 weight percent gelatin and 10 weight percent VERSA TL-130 polystyrene sulfonate.

For purposes of comparison, an element referred to as Comparative Element 1 was prepared which was outside the scope of the present invention because the content of polystyrene sulfonate in the electrically-conductive layer was too great. In this element, the binder was a blend of 83.3 weight percent gelatin and 16.7 weight percent VERSA TL-130 polystyrene sulfonate and the dry coating weight was the same as for Control Element 1.

The values obtained for SER and the AO wet abrader values are reported in Table I below.

TABLE I

| Example No. | Weight Ratio of $SnO_2$ to Binder | Weight % PSS in the Binder | $SnO_2$ Coverage (mg/m$^2$) | SER (log ohms/sq) | AO Wet Abrader (% removed) |
|---|---|---|---|---|---|
| Control 1 | 90:10 | 0 | 200 | 7.9 | 13.6 |
| Example 1 | 90:10 | 9.1 | 200 | 7.9 | 2.6 |
| Comparative 1 | 90:10 | 16.7 | 200 | 8.0 | 58.2 |
| Control 2 | 90:10 | 0 | 300 | — | 22 |
| Example 2 | 90:10 | 5 | 300 | — | 1 |
| Example 3 | 90:10 | 10 | 300 | — | <1 |

SER values for Control 2 and for Examples 2 and 3 were not measured but would be lower than those for Control 1 because of the higher dry weight coverage of antimony-doped tin oxide. Comparing Example 1 with Control 1, it is apparent that addition of the polystyrene sulfonate to the electrically-conductive layer substantially improved the adhesion between the emulsion layer and the underlying electrically-conductive layer as shown by the much lower degree of removal in the wet abrader test. Addition of an excessive amount of polystyrene sulfonate in Comparative Element 1 had little effect on SER but resulted in much greater removal in the wet abrader test than occurred in Control 1, apparently because the amount of polystyrene sulfonate employed was sufficient to degrade the cohesive strength of the electrically-conductive layer.

Comparing Examples 2 and 3 with Control 2, it is seen that addition of polystyrene sulfonate in appropriate amounts greatly improved the adhesion between the silver halide emulsion layer and the electrically-conductive layer as shown by the much lower levels of removal in the wet abrader test.

In the present invention, the essential components of the electrically-conductive layer are the electrically-conductive metal-containing particles and the binder blend comprising the film-forming polymer and the polymer having anionic moieties that are capable of binding with gelatin. The weight ratio of metal-containing particles to binder blend can vary considerably depending on the desired degree of conductivity and the particular materials utilized. Similarly, the proportions of the two polymers making up the binder blend can vary widely depending on the particular materials utilized. However, the polymer having the anionic moieties must be used in an amount sufficient to improve adhesion but insufficient to significantly degrade the cohesive strength of the electrically-conductive layer.

In the preferred embodiment of the invention which utilizes antimony-doped tin oxide particles, the volume fraction of such particles is preferably in the range of from about 20 to about 80% of the volume of the electrically-conductive layer. This corresponds to an antimony-doped tin oxide to binder blend weight ratio of about 60:40 to about 96:4. In the preferred embodiment of the invention which utilizes as the binder blend a combination of gelatin and polystyrene sulfonate, the polystyrene sulfonate preferably constitutes from 2 to 15 percent by weight, and more preferably 5 to 12 percent by weight, of the binder blend.

The invention has been described in detail, with particular reference to certain preferred embodiments thereof, but it should be understood that variations and modifications can be effected within the spirit and scope of the invention.

We claim:

1. An imaging element for use in an image-forming process; said imaging element comprising a support, an image-forming layer, and an electrically-conductive layer; said electrically-conductive layer being in adhering contact with a layer containing gelatin; and said electrically-conductive layer comprising electrically-conductive metal-containing particles having powder resistivity of $10^5$ ohm-centimeters or less dispersed in a binder system comprising a blend of a film-forming polymer and an anionic polymer that is compatible with said film-forming polymer and has a high gelatin binding efficiency, the ratio of said metal-containing particles to said binder system being sufficient to provide said electrically-conductive layer with a resistivity of less than $1\times10^{12}$ ohms/square and the ratio of said anionic polymer to said film-forming polymer being sufficient to enhance the adhesion of said electrically-conductive layer to said layer in adhering contact therewith but insufficient to significantly degrade the cohesive strength of said electrically-conductive layer.

2. An imaging element as claimed in claim 1, wherein said electrically-conductive metal-containing particles are antimony-doped tin oxide particles.

3. An imaging element as claimed in claim 1, wherein said electrically-conductive metal-containing particles are particles of a metal antimonate.

4. An imaging element as claimed in claim 1, wherein said electrically-conductive metal-containing particles have an average particle size of less than one micrometer.

5. An imaging element as claimed in claim 1, wherein said electrically-conductive metal-containing particles have an average particle size of less than 0.3 micrometers.

6. An imaging element as claimed in claim 1 wherein said electrically-conductive metal-containing particles have an average particle size of less than 0.1 micrometers.

7. An imaging element as claimed in claim 1, wherein the resistivity of said electrically-conductive layer is less than $1\times10^9$ ohms/square.

8. An imaging element as claimed in claim 1, wherein said film-forming polymer is gelatin.

9. An imaging element as claimed in claim 1, wherein said anionic polymer has one or more pendant anionic moieties selected from $—OSO_3M$, $—SO_3M$, —COOM and $—OPO(OM)_2$ where M represents a hydrogen atom or a cationic counterion.

10. An imaging element as claimed in claim 1, wherein said anionic polymer contains sulfonate moieties.

11. An imaging element as claimed in claim 1, wherein said anionic polymer is a copolymer of styrene sulfonate and maleic acid.

12. An imaging element as claimed in claim 1, wherein said anionic polymer is a homopolymer or copolymer of an alkyl vinyl benzene sulfonate.

13. An imaging element as claimed in claim 1, wherein said anionic polymer is polystyrene sulfonate.

14. An imaging element as claimed in claim 1, wherein said electrically-conductive metal-containing particles constitute 50 to 80 percent by volume of said electrically-conductive layer.

15. An imaging element as claimed in claim 1, wherein said support is a transparent polymeric film, said image-forming layer is comprised of silver halide grains dispersed in gelatin, said electrically-conductive metal-containing particles are antimony-doped tin oxide particles, said film-forming polymer is gelatin and said anionic polymer is polystyrene sulfonate.

16. An imaging element for use in an image-forming process; said imaging element comprising a support, an image-forming layer and an electrically-conductive layer; said electrically-conductive layer being in adhering contact with a layer containing gelatin; and said electrically-conductive layer comprising electrically-conductive metal-containing particles having a powder resistivity of $10^5$ ohm-centimeters or less dispersed in a binder system comprising a blend of gelatin and polystyrene sulfonate, the ratio of said metal-containing particles to said binder system being sufficient to provide said electrically-conductive layer with a resistivity of less than $1\times10^9$ ohms/square, and said polystyrene sulfonate being present in said blend in an amount of about 0.04 to about 0.12 parts per part by weight of gelatin.

17. A photographic film comprising (1) a support, (2) an electrically-conductive layer which serves as an antistatic layer overlying said support; and (3) an image-forming layer comprising silver halide grains dispersed in gelatin overlying said electrically-conductive layer and being in adhering contact therewith;

said electrically-conductive layer comprising antimony-doped tin oxide particles having a powder resistivity of $10^5$ ohm-centimeters or less dispersed in a binder system comprising a blend of gelatin and polystyrene sulfonate, the ratio of said antimony-doped tin oxide particles to said binder system being sufficient to provide said electrically-conductive layer with a resistivity of less than $1\times10^9$ ohms/square, and said polystyrene sulfonate being present in said blend in an amount of about 0.04 to about 0.12 parts per part by weight of gelatin.

* * * * *